US010021919B2

(12) United States Patent
Spicuzza et al.

(10) Patent No.: US 10,021,919 B2
(45) Date of Patent: Jul. 17, 2018

(54) METHOD AND DEVICE FOR PROTECTING THE HUMAN BODY FROM FOOT STRIKE SHOCK

(75) Inventors: Ellen Frieder Spicuzza, Canton, MA (US); Alicia M. Sacramone, Winchester, MA (US)

(73) Assignee: Soleimpact, Inc., Canton, MA (US)

( * ) Notice: Subject to any disclaimer, the term of this patent is extended or adjusted under 35 U.S.C. 154(b) by 792 days.

(21) Appl. No.: 13/699,865

(22) PCT Filed: May 26, 2011

(86) PCT No.: PCT/US2011/038074

§ 371 (c)(1),
(2), (4) Date: Feb. 26, 2013

(87) PCT Pub. No.: WO2011/150166

PCT Pub. Date: Dec. 1, 2011

(65) Prior Publication Data

US 2013/0145521 A1 Jun. 13, 2013

Related U.S. Application Data

(60) Provisional application No. 61/348,317, filed on May 26, 2010.

(51) Int. Cl.

| | |
|---|---|
| ***A41B 11/00*** | (2006.01) |
| ***A41B 11/02*** | (2006.01) |
| ***A41D 31/00*** | (2006.01) |
| ***A41D 13/015*** | (2006.01) |

(52) U.S. Cl.
CPC ..... *A41B 11/007* (2013.01); *A41B 11/008* (2013.01); *A41B 11/02* (2013.01); *A41D 13/015* (2013.01); *A41D 31/0044* (2013.01); *A41B 2400/60* (2013.01)

(58) Field of Classification Search
CPC ..... A41D 31/0044; A41D 13/06; D04B 1/26; D04B 9/46; D04B 9/56; A41B 11/007; A41B 11/008; A41B 11/02; A41B 11/005; A41B 11/006
USPC ..... 2/22, 61, 239–242; 602/61–63, 65, 66
See application file for complete search history.

(56) References Cited

U.S. PATENT DOCUMENTS

| | | | | | |
|---|---|---|---|---|---|
| 1,741,340 | A * | 12/1929 | Scholl | A41B 11/006 | 2/239 |
| 1,811,786 | A * | 6/1931 | Frei | D04B 9/46 | 2/239 |
| 3,322,118 | A * | 5/1967 | Sotherlin | A61F 13/069 | 128/881 |
| 3,648,291 | A * | 3/1972 | Pankers | A61F 13/101 | 128/892 |
| 3,990,440 | A * | 11/1976 | Gaylord, Jr. | A61F 13/101 | 128/892 |
| 4,150,442 | A * | 4/1979 | Boone | A41D 13/06 | 128/892 |

(Continued)

*Primary Examiner* — Jameson Collier
(74) *Attorney, Agent, or Firm* — MacCord Mason PLLC

(57) ABSTRACT

A shock-absorbing sock is shown and described. In one embodiment, the sock is a shock-absorbing athletic sock generally conforming to the shape of a human foot that includes a heel portion, a mid-foot portion and a shock absorbing assembly. The shock absorbing assembly may include a cavity assembly and a shock absorbing material. In other embodiments, the sock may include a slip-avoidance system.

5 Claims, 16 Drawing Sheets

(56) References Cited

U.S. PATENT DOCUMENTS 4,179,826 A * 12/1979 Davidson ..... A43B 21/32 36/129
4,194,249 A 3/1980 Thorneburg ..... 2/239
4,206,515 A 10/1980 Robinson
4,277,959 A 7/1981 Thorneburg ..... 66/182
4,325,380 A * 4/1982 Malkin ..... A43B 21/32 36/140
4,372,057 A * 2/1983 Nielsen ..... A43B 17/102 36/10
4,520,635 A 6/1985 Shields et al. ..... 66/185
4,534,121 A * 8/1985 Autry ..... A43B 7/142 36/35 R
4,619,056 A * 10/1986 Lin ..... A43B 7/142 36/145
4,777,739 A 10/1988 Hiles ..... 36/43
4,808,469 A 2/1989 Hilels ..... 428/318.6
5,015,427 A * 5/1991 Sosnow ..... A43B 7/14 264/115
5,203,793 A * 4/1993 Lyden ..... A43B 3/0063 12/142 N
5,335,517 A 8/1994 Throneburg et al. ..... 66/185
5,724,753 A 3/1998 Throneburg et al. ..... 36/91
5,737,776 A 4/1998 Jennings ..... 2/409
5,749,100 A * 5/1998 Rosenberg ..... D04B 1/26 2/239
5,787,610 A 8/1998 Brooks ..... 36/28
5,791,163 A 8/1998 Throneburg ..... 66/178 R
5,867,838 A * 2/1999 Corry ..... A43B 17/00 2/239
6,021,527 A 2/2000 Lessard ..... 2/239
6,032,296 A * 3/2000 Kelly ..... A41B 11/00 2/239
6,059,744 A * 5/2000 Hardt ..... A61F 13/066 602/27
6,093,468 A 7/2000 Toms et al. ..... 428/67
6,187,837 B1 * 2/2001 Pearce ..... A43B 13/04 36/32 R
6,275,997 B1 8/2001 Richardson ..... 2/239
6,446,267 B1 9/2002 Shah ..... 2/239
6,558,339 B1 * 5/2003 Graham ..... A61F 5/0113 128/882
D476,147 S * 6/2003 Campbell ..... D2/980
6,886,276 B2 * 5/2005 Hlavac ..... A61F 5/14 2/240
7,056,299 B2 * 6/2006 Brown ..... A61F 5/30 128/892
7,107,626 B1 * 9/2006 Andrews ..... A41B 11/004 2/239
8,205,271 B2 * 6/2012 Canci ..... A44B 11/02 2/239
2002/0083511 A1 * 7/2002 Glogover ..... A41B 11/00 2/239
2003/0041481 A1 * 3/2003 Evans ..... A43B 7/14 36/145
2006/0026740 A1 * 2/2006 Vargas ..... A41B 11/02 2/239
2006/0143801 A1 7/2006 Lambertz
2006/0143802 A1 * 7/2006 Butz ..... A41B 11/007 2/239
2006/0179549 A1 * 8/2006 Huggins ..... A41B 11/004 2/239
2006/0195971 A1 * 9/2006 Lambertz ..... A41B 11/00 2/239
2006/0225186 A1 10/2006 Davenport
2007/0192938 A1 * 8/2007 Yoon ..... A41B 11/00 2/239
2008/0060118 A1 * 3/2008 Stuart ..... A41B 11/00 2/240
2008/0092275 A1 * 4/2008 Wei ..... A41B 11/08 2/242
2009/0094861 A1 * 4/2009 Orvitz ..... A43B 1/0081 36/91
2009/0095026 A1 4/2009 Araki et al. ..... 66/187
2009/0113603 A1 * 5/2009 Liu ..... A41B 11/007 2/240
2010/0088804 A1 * 4/2010 Crosby ..... A41B 11/004 2/239
2011/0061148 A1 * 3/2011 Egozi ..... A41B 11/007 2/239
2011/0289657 A1 * 12/2011 Starr ..... A41B 11/00 2/240
2014/0230131 A1 * 8/2014 Alston ..... A41B 11/007 2/239
2014/0338090 A1 * 11/2014 Perkins ..... A41B 11/007 2/22

* cited by examiner

METHOD AND DEVICE FOR PROTECTING THE HUMAN BODY FROM FOOT STRIKE SHOCK

This application is based on and claims priority to PCT/US2011/38074, filed May 26, 2011, which further claims priority to U.S. Provisional Patent Application No. 61/348,317, filed May 26, 2010, the teachings of which are all incorporated herein by this reference in their entireties.

FIELD OF THE TECHNOLOGY

The present disclosure relates generally to socks, and more particularly to socks to dampen foot strike shock on a human foot.

BACKGROUND

The strike of the foot to a variety of surfaces creates a shock which can damage a person's body. Such damage may occur in many parts of the body, for example the feet, which have many bones and many jointed surfaces, and in the knees and the spinal cord. During repetitive and/or high impact athletic activity, the beating and shock may cause stress fractures in the feet, leg and other areas. Similarly, the shocks can cause changes in the structure of the vertebrae.

In young athletes, such as gymnasts, repetitive and high impact activity can also lead to growth plate damage and unintended changes. For illustrative purposes only, gymnasts that perform balance beam exercises are required to land repeatedly on the beam surface, typically with little, or no, protective foot covering to absorb foot strike shock. Even though current beam surfaces are typically sprung and made of leather or suede, repeated landing on that surface wears at the gymnast's body.

Therefore, an improved athletic sock and method of using thereof for shock absorption may be advantageous, particularly when used by gymnasts. However, embodiments of the sock may provide improved shock absorption for all wearers, including a variety of athletes and non-athletes alike. For instance, in some sports, such as running, there are devices available to help alleviate the reoccurrence of foot strike shock; however, such conventional approaches are often inadequate, or even ineffective. For example, conventional approaches are often bulky and disadvantageous for athletes, particular those athletes trending towards more minimalistic footwear.

Therefore, the Applicants herein describe embodiments, and methods of using those embodiments, for shock absorption that can be donned in many athletic endeavors, such as gymnastics and running, which may benefit from minimal foot coverings and support, yet impose repetitive or high impact shock on the athletes' feet.

SUMMARY

In accordance with the present disclosure, a shock-absorbing sock is provided to absorb foot strike shock to prevent and rehabilitate human injury. This disclosure provides an improved sock that is convenient, efficient, and safe for the user, particularly when used during athletic activity and/or during rehabilitation. This disclosure may allow for half-foot socks, ankle with closed forefoot socks, ankle with open forefoot socks, three-quarter foot socks, calf socks, legging socks, and combination thereof. This disclosure may also provide an improved method of preventing foot strike shock by donning a shock-absorbing sock, particularly during athletic activity and/or rehabilitation.

In one embodiment, a shock-absorbing athletic sock includes a heel portion, a mid-foot portion and a shock absorbing assembly. The shock absorbing assembly may include a cavity assembly and a shock absorbing material generally secured in the cavity. In particular examples, an inner wall and an outer wall may define the cavity. The inner wall and the outer wall may be stitched together. In particular examples, the stitching may be elastic stitching that is generally adapted to allow flexibility and movement of the inner wall and outer wall about one another.

The cavity may wick moisture away from a user's foot, particularly during athletic activity. The sock may further include at least one layer that is adjacent to the cavity. The layer may be a wicking layer, a protective layer and an adhesive layer. The cavity may have sufficient memory to hold the cavity in place, particularly when being donned during athletic activity.

In some examples, the shock absorbing material may be gel, for instance a visco-elastic polymeric gel. In particular examples, the shock absorbing material may be a Sorbothane gel. The shock absorbing material may be adapted to flow and absorb shock under a load. The shock absorbing material may be adapted to mimic an elasticity of human flesh. The shock absorbing material may absorb greater than about 94 percent, for example 94.7 percent, of impact shock. Further, the shock absorbing assembly may cushion a human foot from foot-strike shock while the mid-foot portion allows tactility in the ball area and toes.

In another embodiment, a shock-absorbing athletic sock may have a shape generally conforming to the shape of a human foot and include a heel portion, a mid-foot portion and a shock absorbing assembly. The shock absorbing assembly may include a cavity assembly and a shock absorbing material.

In some examples, the sock may include a slip-avoidance system. The slip-avoidance system may include a plurality of grooves. The slip-avoidance system may also include a stick pad.

Typically, the sock is adapted to be donned without a shoe. In particular examples, the heel portion includes a cuff that is generally adapted to prevent slippage of the sock from a human foot. Further, the said mid-foot portion may include a cuff that is generally adapted to prevent slippage from the mid-foot.

In other embodiments, a shock-absorbing athletic sock has a shape that is generally conforming to the shape of the human foot. The sock may include a heel portion, a mid-foot portion, a shock absorbing assembly and a slip-avoidance system. The shock absorbing assembly may include a cavity assembly and a shock absorbing material.

In yet other embodiments, a shock-absorbing athletic sock having a shape generally conforming to the shape of a human foot includes a mid-foot portion, a heel portion and an ankle cuff on the proximate end of the sock. The mid-foot portion may expose a ball area and toes of the foot. Further, the mid-foot portion may include a mid-foot cuff on the distal end of the sock that is adapted to prevent slippage from the mid-foot. The heel portion may include a visco-elastic polymeric shock-absorbing gel heel portion. The ankle cuff on the proximate end of the sock may be adapted to prevent slippage from the human foot.

Further, the shock absorbing material may cushion the human foot from foot-strike shock, while the mid-foot portion may allows tactility in the ball area and toes. In other examples, the shock absorbing material may include slip avoidance grooves. For instance, the slip avoidance grooves in the mid-foot portion, and/or heel portion, may cushion the human foot from foot-strike shock while allowing the mid-foot portion and heel portion to flex.

Particular injuries associated with foot strike shock, and similar repetitive impact, and other injuries include stress factures, growth plate deformities, knee injuries, Achilles tendonitis, shin splints, heel pain and fractures, planter fasciitis, hip injuries, disc compression, muscular spasms, ankle injuries, sciatica, injuries incurred by overuse (including overuse injuries to the lower back, hips, knees, ankles, feet), tarsal, neuromas of the feet and the like. Embodiments of the socks herein will aid in the absorption of shock and impact to reduce, and even prevent, many of the above injuries. In particular applications, reducing shock and impact will enhance performance with minimizing, or even eliminating, down time.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
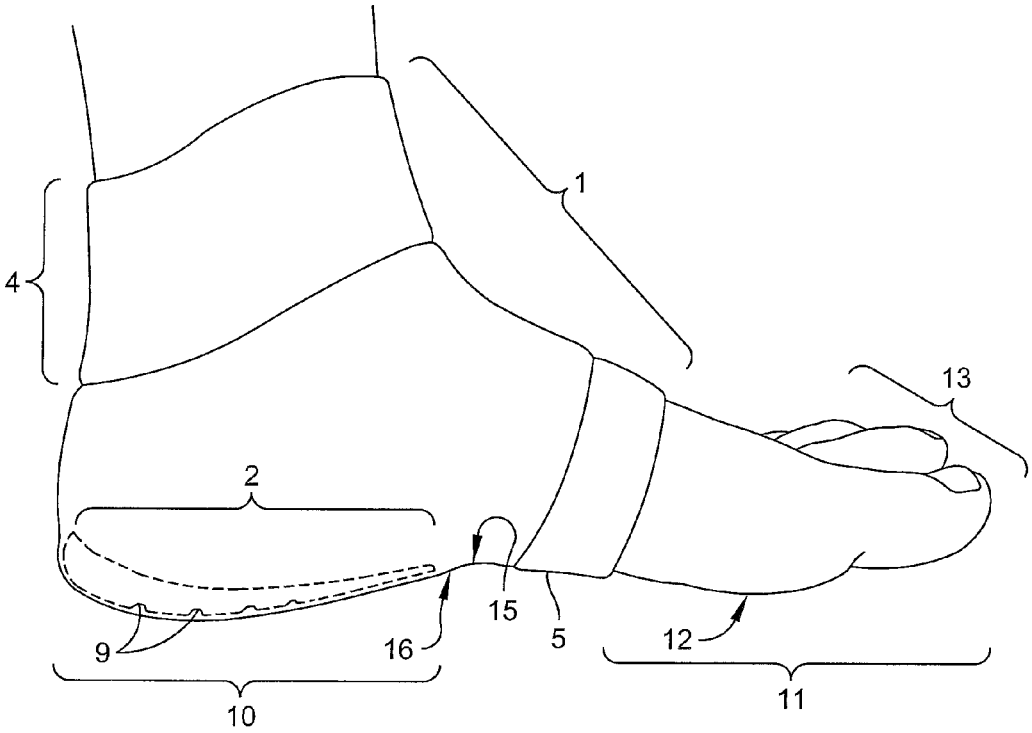
FIG. 1 is a side view of a half-foot sock embodiment with cuffs at the ankle and mid-foot and placement of shock absorbing material, shown in the dotted line, in a heel portion.

In the following description, like reference characters designate like or corresponding parts throughout the several views. Also in the following description, it is to be understood that such teems as "forward," "rearward," "left," "right," "upwardly," "downwardly," and the like are words of convenience and are not to be construed as limiting terms.

Referring now to the drawings in general and FIGS. 1, 7, 9, 11 and 13 in particular, it will be understood that the illustrations are for the purpose of describing embodiments of the disclosure and are not intended to limit the disclosure or any inventions thereto. As shown in these figures, the foot-strike shock socks are generally configured to protect and/or rehabilitate a wearer from bodily injury, particularly during athletic activity. For instance, the socks may help absorb shock and protect a users' heel section, ball area, i.e. the portion of the sole of the foot between the toes and the arch, and a combination thereof when the weight of the body strikes or moves on a surface, while wicking away moisture. However, it is within the spirit of this disclosure for foot-strike shock sock embodiments to be used in other non-athletic situations, for example where risk of bodily injury is apparent or during other bodily rehabilitation.

Embodiments of the socks include a variety of covering for the human foot, for instance a covering for the whole foot or a covering for only a portion of the foot. For example, embodiments of the sock may include a covering for the foot that reaches below the ankle, while other embodiments include a covering that reaches between the ankle and the foot. Further, in some embodiments, the socks may be donned without additional foot covering, i.e. without shoes or the like, as discussed herein. However, other embodiments of the socks may be worn with additional foot coverings, such as shoes, cleats, skates, rehabilitation coverings and other athletic footwear.

Figure 11:
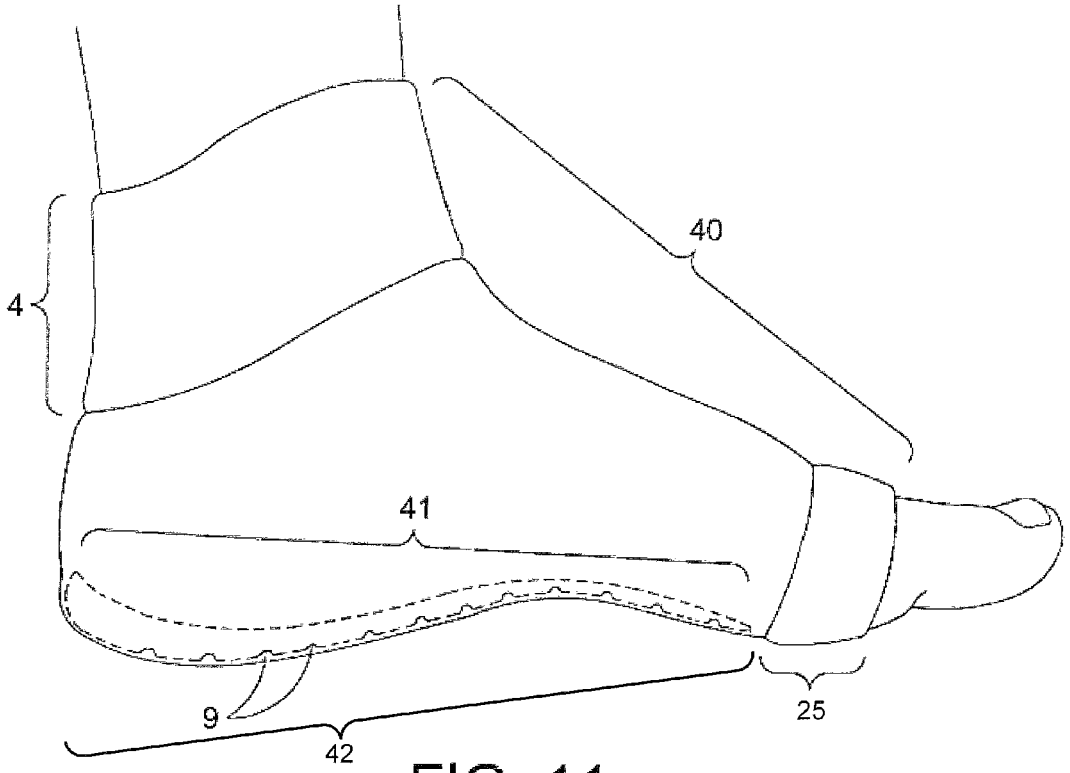
FIG. 11 is a side view of a three-quarter foot sock embodiment with shock absorption running from heel to the ball portion of the forefoot.

FIG. 1 illustrates half-foot sock 1, which is representative of one embodiment of a foot-strike shock sock discussed herein. In this example, half-foot sock 1 has a shape generally conforming to the shape of the human foot and includes heel shock absorbing assembly 10. Half-foot sock is generally secured to the human foot with ankle cuff 4 and mid-foot cuff 5. Typically, as shown in FIG. 11, heel shock absorbing assembly may include a cavity assembly, heel shock absorbing material 2 and a plurality of slip avoidance grooves 9 to provide tactility and wick away moisture from the human foot.

Figure 2:
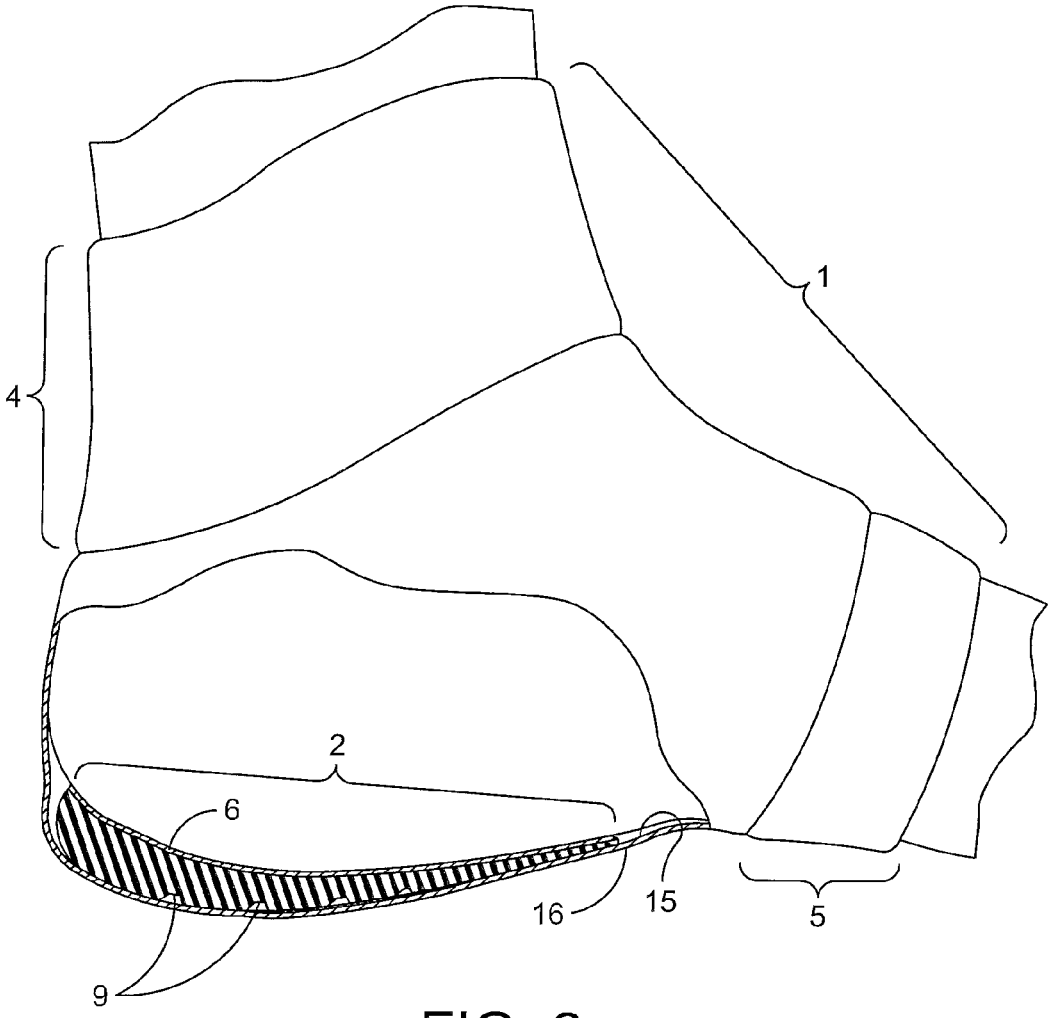
FIG. 2 is a cross-section of the half-foot sock of FIG. 1.

As shown in FIGS. 1 and 2, the cavity assembly may be defined by an inner wall 15 and an outer wall 16. Inner wall 15 and outer wall 16 may be stitched together, and in particular examples, inner wall 15 and outer wall 16 may be stitched together with elastic stitching to allow flexibility and movement of inner wall 15 about and outer wall 16. Inner wall 15 and outer wall 16 may also be constructed of a variety of donning apparel materials that provide sufficient compression to retain the sock during activity, while maintaining tactility and wicking away moisture. In examples hereinafter, the inner wall and the outer wall may include a composition of nylon, cotton and LYCRA® spandex fiber. In a specific example, the composition includes about fifty-one percent nylon, about forty-seven percent cotton-elastic and about two percent LYCRA® spandex fiber. Other examples include a variety of compositions that provide compressibility and tactility, while wicking moisture away from the human foot.

Typically, inner wall 15 and outer wall 16 have a shape generally conforming to the shape of the human foot. Throughout the various examples of socks herein, each inner wall and outer wall may be single layered or double layered, and can be composed of a variety combinations to match a specific intended usage. However, many of such embodiments are generally stretchable and, therefore, typically hug tightly to the foot when donned.

Further, the cavity assembly may include a variety of additional layers for enhanced performance of the sock, particularly during athletic activity. For instance, the sock may include a wicking material layer 19, an adhesive layer 18, an additional protective material layer and a combination thereof.

In examples herein, wicking material layer 19 may draw moisture from the human foot away from sock 10 or to outer layers. Wicking layer 19 may be a synthetic material, such as a microfiber and polyester based fabric to transfer moisture. For instance, the capillary action of wicking layer 19 may move moisture away from the skin into nonabsorbent materials with greater surface area for improved evaporation. The wicking layer 19 may therefore improve tactility and performance of the sock, while improving the wearer's comfort. Further, other embodiments may include anti-bacterial agents to help reduce odors and extend the sock's product life.

In other examples herein, adhesive layer 18 may help bond the multiple layers of the sock. In yet other examples, an additional protective material layer is positioned in one or all ground touching portions of the sole portion of the sock. In such examples, the protective material layer may be positioned on the sole portion which typically contacts a floor, beam or the like surface during upright standing and/or during traditional athletic activity, for instance such as running or gymnastics. The protective layer may be a layer of leather, such as a thin layer of leather similar to the bottom of ballet shoes. Such a thin layer of leather may be particularly advantageous in embodiments that can be used for running and other outdoor repetitive activities, particular those activities that often subject the outer wall of the sock to tearing and wearing away.

The heel shock absorbing material 2 is representative of one embodiment of absorbing materials discussed herein. Generally, the shock absorbing materials may vary from example to example and embodiment to embodiment. Shock absorbing material may be positioned adjacent to the inner wall in a variety of positions and can be attached directly to the inner wall such as by gluing, stitching or the like. Typically, shock absorbing material acts to dampen, or eliminate, shock generated during activity causing foot strike concerns. Shock absorbing material may be chosen from a variety of materials or constructions. For example, shock absorbing material may include a gel, and in particular a visco-elastic gel.

Typically, the shock absorbing material may compress in stages subject to different controlling pressure factors. For instance, the shock absorbing material may compress in a first phase during which the shock absorbing material is distorted when the user puts weight on a defined point during athletic movement, e.g. a gymnastic movement or the like, until the shock absorbing material distorts to a s second phase during a constant pressure, e.g. the user balancing weight in a normal standing position. The first phase compression of the shock absorbing material may depend on various factors. For instance, the size of the shock absorbing material will tend to impact the load bearing and load redirection.

The shock absorbing material of any of the embodiments herein may comprise of SORBOTHANE® (SORBOTHANE® is a registered trademark of Sorbothane, Inc. Kent, Ohio) visco-elastic gel. SORBOTHANE® is a highly-damped, visco-elastic polymer. Typically, the visco-elastic material combines the properties of a viscrose liquid and an elastic solid. In particular examples, the shock absorbing material includes liquid-solid properties that flow, similar to a liquid, under a predetermined load. Simultaneously, SORBOTHANE® shock absorbing material absorbs shock and vibration energy. The shock absorbing material partially collapses under compressive pressure and rebounds when the compressive pressure is removed.

Other embodiments of shock absorbing material include materials with similar visco-elastic properties to SORBOTHANE® As illustrated in 1, 7, 9, 11 and 13, the placement and size of the shock absorbing material in proportion to the surface area of sock between the human foot and a surface on which the weight of the body rests vary from embodiment to embodiment, depending on the use. In some embodiments, shock absorbing material may be located on specific placements along the foot, while other embodiments include shock absorbing material spanning up to the whole foot bottom. Typically, the shock absorbing material protects and cushions any of the heel, ball and/or inner portions of the arch of the user's foot, thereby reducing the shock normally imparted to the heel, ball and inner portions of the arch of the foot so that normal articulation of the bones in the feet takes place when the wearer is conducting physical activity, and gymnastics in general. Therefore, certain embodiments herein need not necessarily conform to the whole bottom of the foot, insofar as the whole bottom area of the foot may not benefit from shock protection during specific applications.

Returning to FIG. 1, half-foot sock 1 includes heel shock absorbing material 2 that is positioned within the cavity of heel shock absorbing assembly 10. In this example, heel shock absorbing material 2 is secured within the cavity defined by inner wall 15 and outer wall 16. In this particular embodiment, shock absorbing material is provided only in the heel area of half-foot sock 1. Here, forefoot 11, including ball of foot 12 and toes 13, are shown exposed with shock absorbing material 2 secured in the heel 10 area. This embodiment is particularly advantageous for athletes, including gymnasts, which may benefit from having the ball area free of additional material to allow maximum tactility in the ball and toe areas, while still absorbing harmful heel shock and wicking moisture away from the human foot.

Other embodiments of the half-foot sock 1 include an elongated forefoot area, where shock absorbing material is secured in the ball area of the sock. In these embodiments, the shock absorbing material may be secured within a cavity assembly in the forefoot having a similar inner wall and outer wall as seen in the heel cavity assembly described above.

Shock absorbing material 2 may also include slip-avoidance grooves 9, as indicated in FIGS. 1 and 2. Typically, slip-avoidance grooves 9 formed in the shock absorbing material provide for flexibility, for example to minimize, or prevent, slippage against inner wall 15. Slip-avoidance grooves 9 also maintain a specific compression across the face of shock absorbing material 2 during the change in load phases discussed above, for instance during load-bearing movements of athletics. Slip-avoidance grooves 9 may also encourage the passage of air through predetermined channels to enhance user comfort. Further, slip-avoidance grooves 9 may channel and wick moisture away from the human foot.

As illustrated in FIG. 1, half-foot sock 1 further includes an ankle cuff 4 on its distal end that is adapted to prevent slippage of the sock from the human foot Ankle cuff 4 may include a fastener to further secure half-foot sock 1 to a human foot, particularly during athletic activity. Similarly, half-foot sock 1 includes a mid-foot cuff 5 on its proximate end that is adapted to prevent slippage from a user's mid-foot. The mid-foot cuff 5 may also include a fastener to further secure half-foot sock 1 to a user's forefoot, particularly during athletic activity.

FIG. 2 shows optional wicking layer 6 secured above inner wall 15 to additionally draw moisture from the human foot away toward the outer layers, i.e. heel shock absorbing material 10 and/or outer wall 16. As indicated above, wicking layer 6 may therefore improve tactility and performance of the sock, while improving the wearer's comfort.

Figure 3:
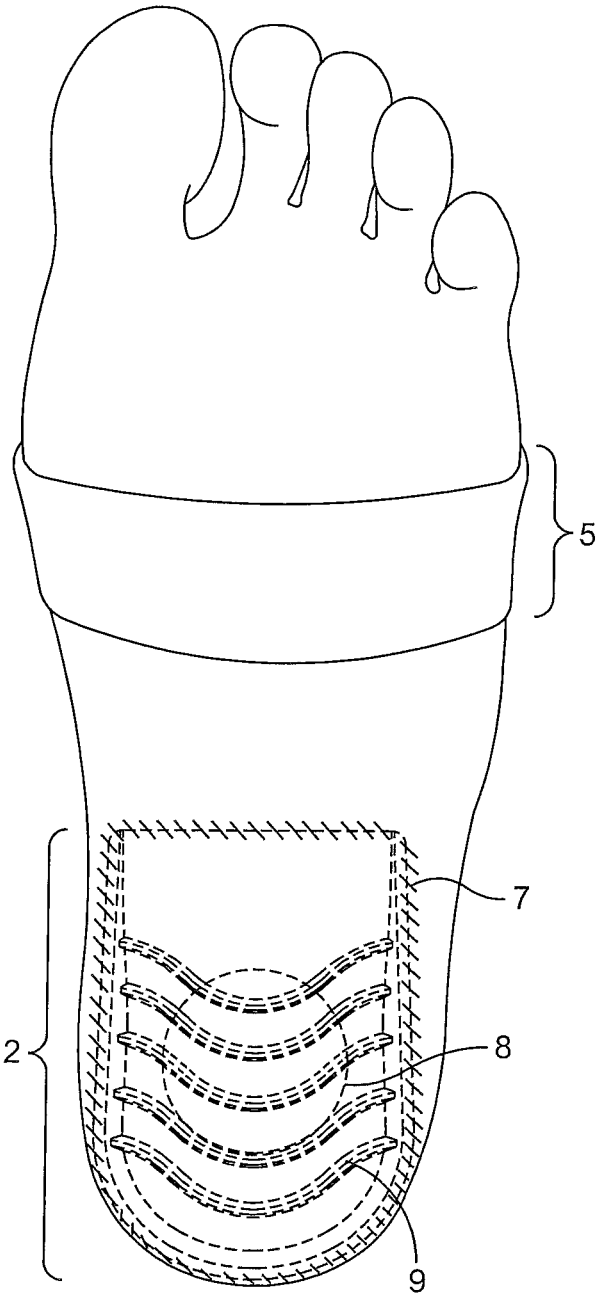
FIG. 3 is a bottom view of the half-foot sock of FIGS. 1 and 2.
Figure 4:
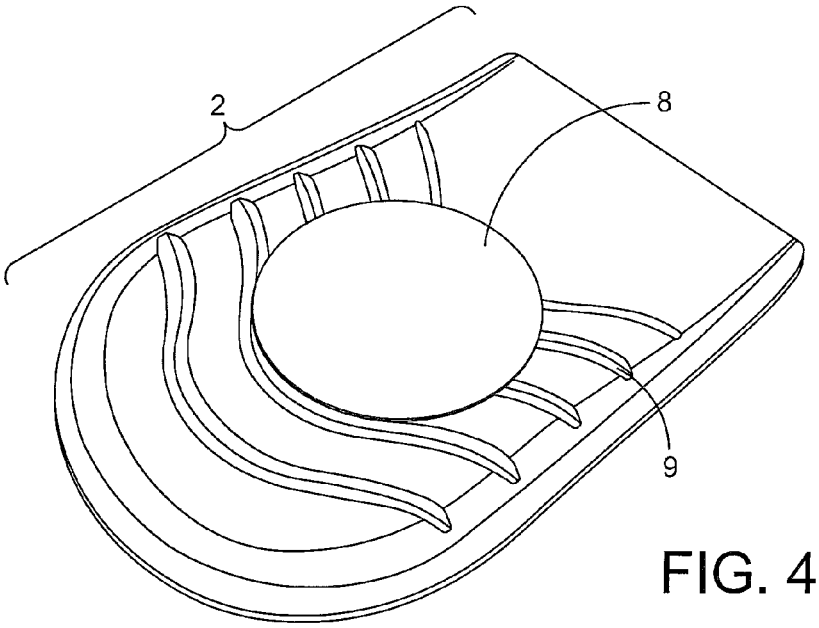
FIG. 4 is a top-view of a shock absorbing material prior to installation within the footwear with adhesive covering intact.
Figure 5:
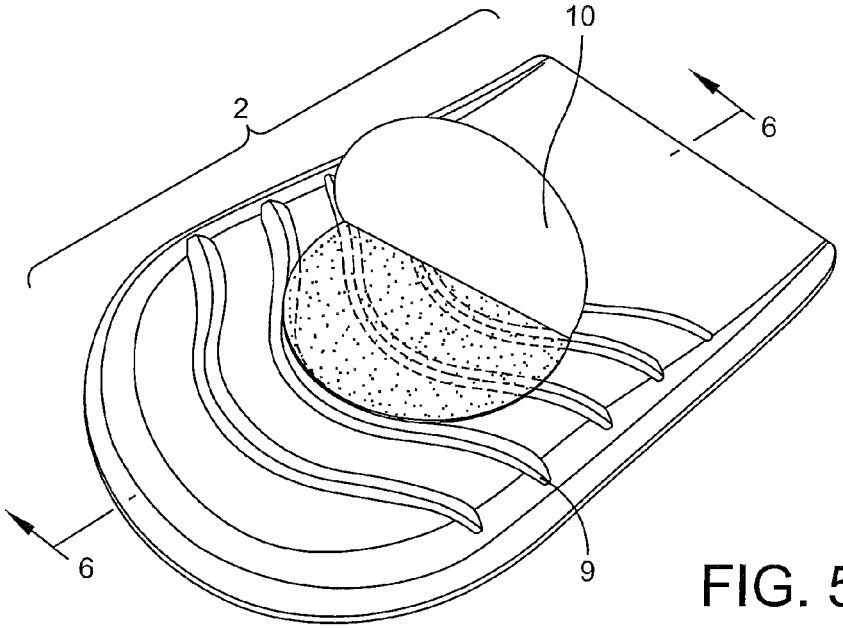
FIG. 5 is a top-view of a shock absorbing material prior to installation within the footwear with adhesive covering partially removed.

FIG. 3 illustrates one example of the half-foot sock 1, wherein stitching 7 secures shock absorbing material 2 to the cavity assembly. Further, stitching 7 may secure inner wall 15 and outer wall 16. In other examples, a stick pad 8 may assist securing shock absorbing material 2 in place to provide enhanced adhesion to inner wall of sock 15. FIG. 4 shows one embodiment of heel shock absorbing material 2 prior to installation within the cavity assembly, with the adhesive covering of stick pad 8 intact. FIG. 5 illustrates shock absorbing material 2 prior to installation within the cavity assembly, but with the adhesive covering of stick pad 8 partially removed.

Figure 6:
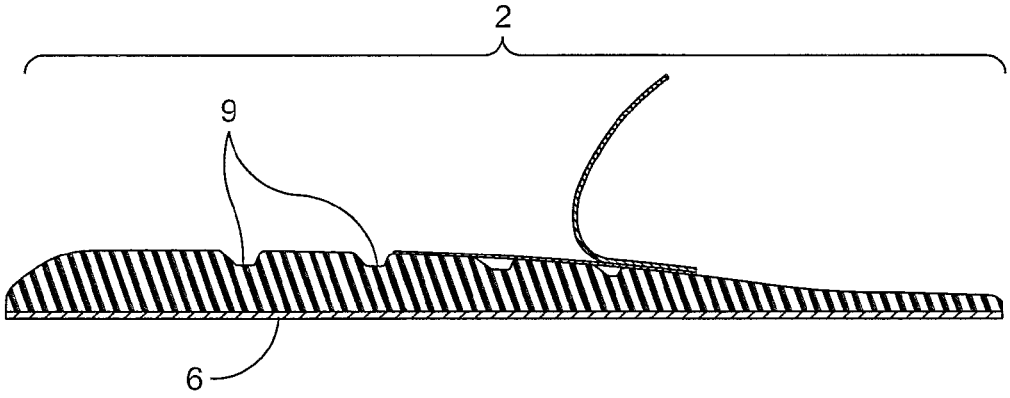
FIG. 6 is a cross-section of FIG. 5 showing various layers of a shock absorbing material including a moisture wicking layer.

FIG. 6 is an isolated view of the various elements of shock absorbing assembly 10, including slip-avoidance grooves 9 and optional wicking layer 6.

Figure 7:
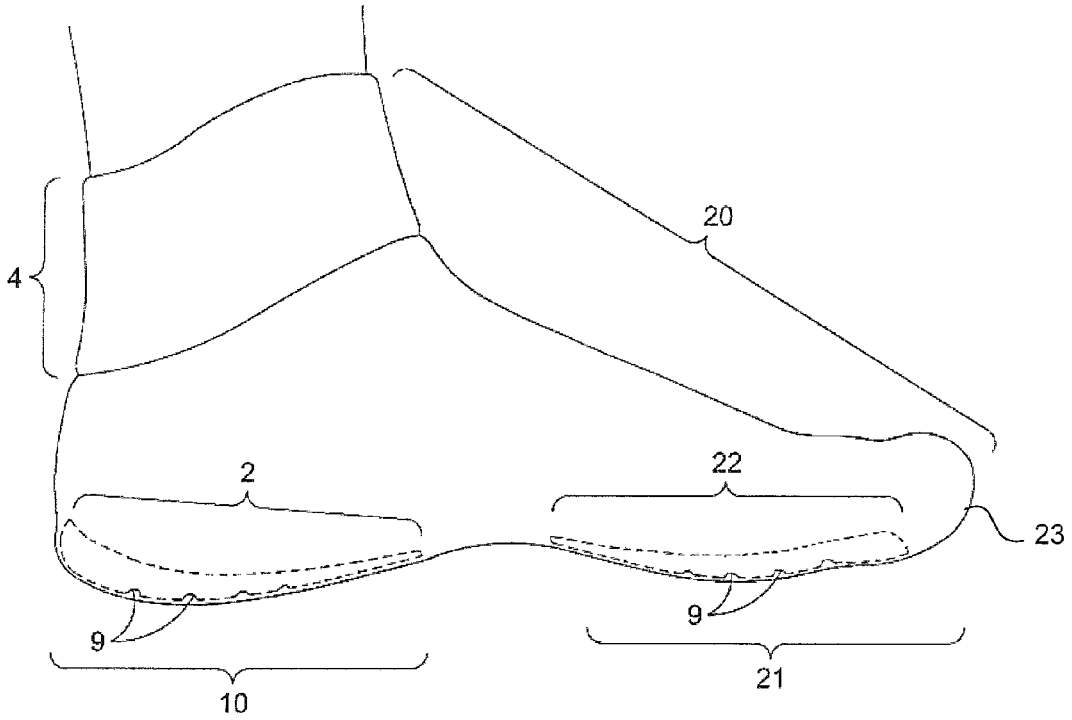
FIG. 7 is a side-view of an ankle-with-open-forefoot sock embodiment with separate shock absorbing material in the heel portion and forefoot portion.
Figure 8:
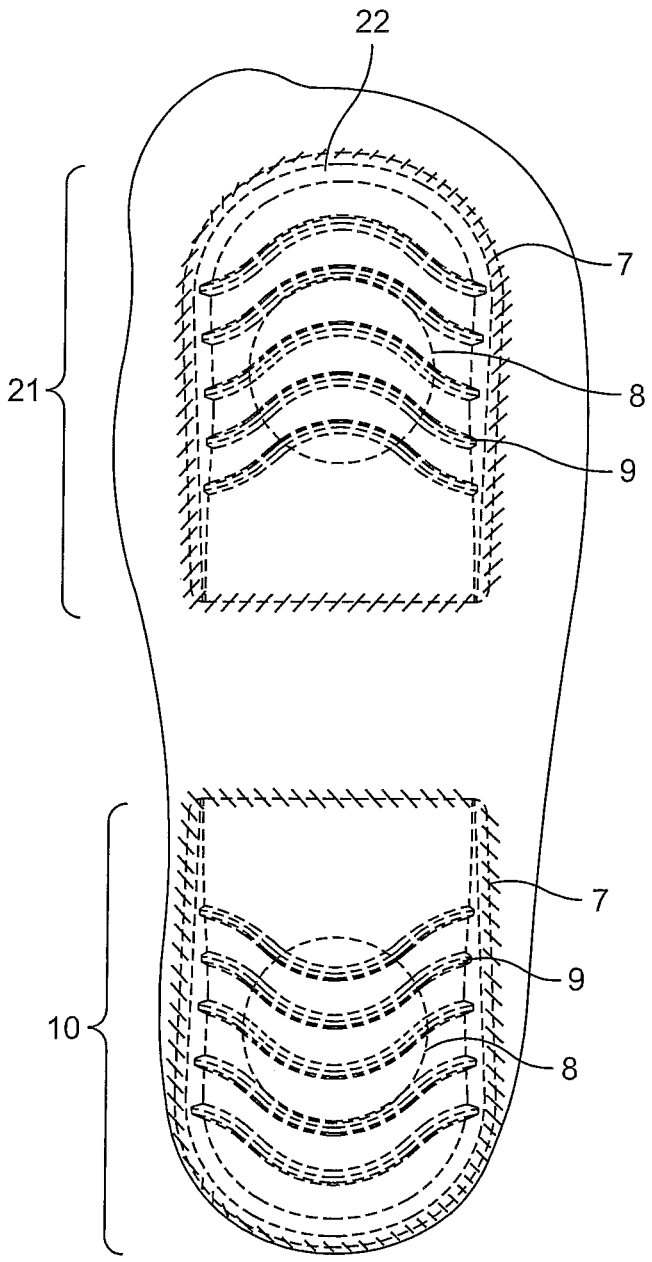
FIG. 8 is a bottom view of the FIG. 7 ankle-with-open-forefoot sock embodiment.

FIGS. 7-8 show another embodiment of the sock: an ankle-with-closed-forefoot sock 20. In this particular example, ankle-with-closed-forefoot sock 20 includes a closed forefoot 23. As indicated in FIG. 7, ankle-with-closed-forefoot sock 20 includes both ball-of-foot shock absorbing assembly 21 and heel shock absorbing assembly 10, both positioned within their corresponding cavities. As explained above, the corresponding cavity assemblies may be defined by an inner wall and an outer wall. The ball-of-foot shock absorbing assembly 21 and heel shock absorbing assembly 10 may include slip-avoidance grooves 9.

Ankle-with-closed-forefoot sock 20 further includes ankle cuff 4 on its distal end that is adapted to prevent slippage of the sock from the human foot. Ankle cuff 4 may include a fastener to further secure half-foot sock 1 to a human foot, particularly during athletic activity. Optionally, ankle-with-closed-forefoot sock 20 may include a wicking layer that is secured above the inner wall of the cavities to additionally draw moisture from the human foot away from sock 20 to the outer layers.

FIG. 8 shows one example of the ankle-with-closed-forefoot sock 20, wherein stitching 7 secures shock absorbing material 22 within ball-of-foot shock absorbing assembly 21 and heel shock absorbing assembly 10. Further, a stick pad 8 may be secured within ball-of-foot shock absorbing assembly 21 and within heel shock absorbing assembly 10, to assist in securing forefoot shock absorbing material 22 and heel shock absorbing material 2 in place to provide enhanced adhesion to the respective inner walls.

Figure 9:
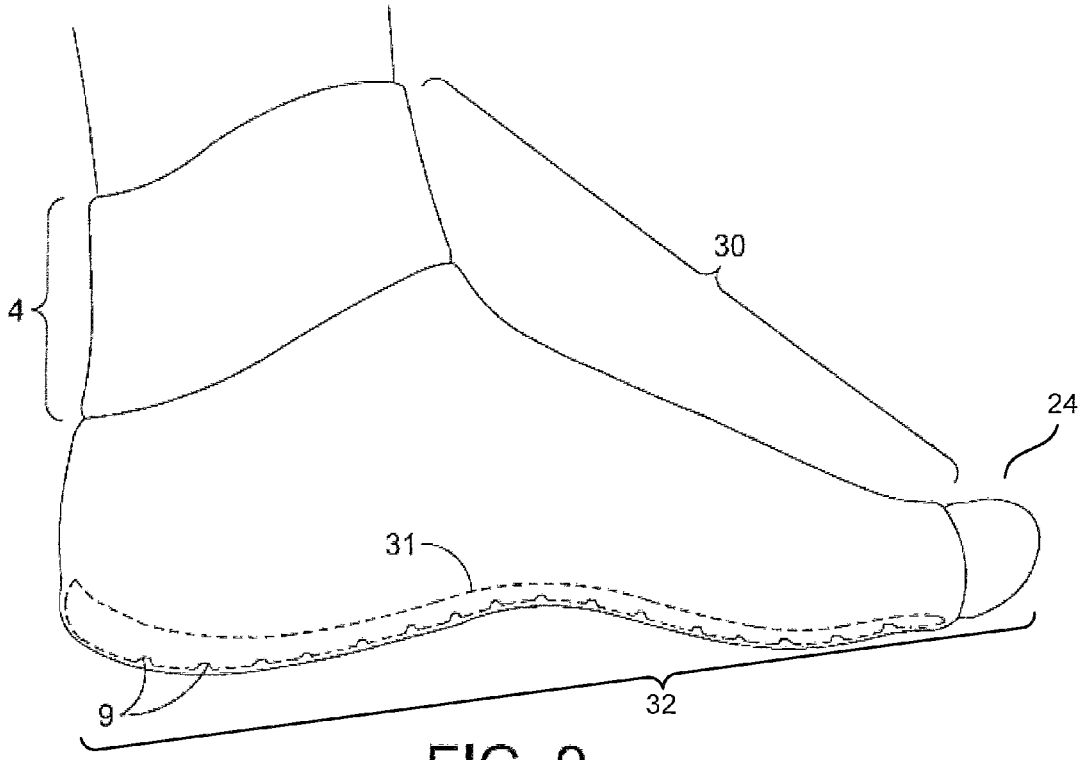
FIG. 9 is a side-view of the ankle-with-open-forefoot sock embodiment of FIG. 7 with shock absorbing material running from heel to forefoot.
Figure 10:
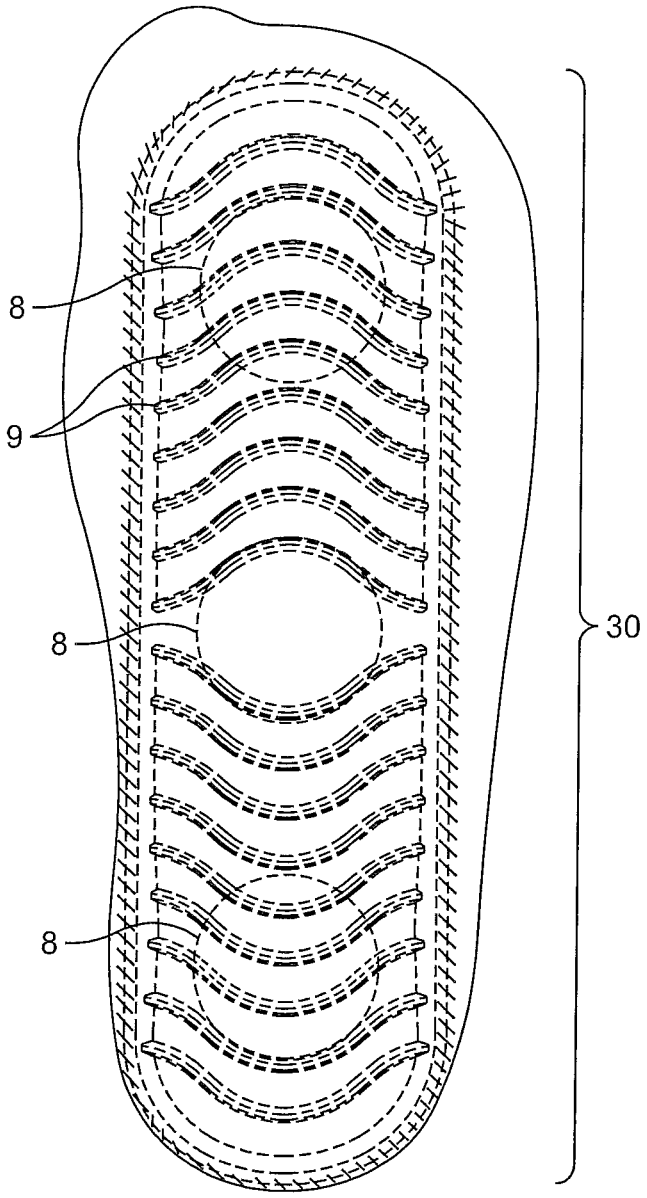
FIG. 10 is a bottom view of the ankle-with-open-forefoot sock embodiment of FIG. 9.

FIGS. 9-10 show yet another embodiment of the sock: an ankle-with-open-toe sock 30. In this particular example, ankle-with-open-toe sock 30 includes an open toe 24 for enhanced tactility, particularly during athletic activity. As indicated in FIG. 9, ankle-with-open-toe sock 30 includes a heel-to-toe foot shock absorbing assembly 32 within a cavity running from about the heel to about the toe. The cavity may be defined by an inner wall and an outer wall. The heel-to-toe foot shock absorbing assembly 32 may include heel-to-toe foot shock absorbing material 31. The heel-to-toe foot shock absorbing material 31 may include slip-avoidance grooves 9.

Ankle-with-open-toe sock 30 further includes ankle cuff 4 on its distal end that is adapted to prevent slippage of the sock from the human foot. Ankle cuff 4 may include a fastener to further secure ankle-with-open-toe sock 30 to a human foot, particularly during athletic activity. Optionally, ankle-with-open-toe sock 30 may include a wicking layer that is secured above the inner wall of the cavities to additionally draw moisture from the human foot and toward outer layers.

FIG. 10 shows one example of the ankle-with-open-toe sock 30, wherein stitching 7 secures heel-to-toe foot shock absorbing material 31 within heel-to-toe foot shock absorbing assembly 32. Further, a stick pad 8 may be secured heel-to-toe foot shock absorbing assembly 32 to assist in securing heel-to-toe foot shock absorbing material 31 within its respective cavity, particularly against its inner walls.

Figure 12:
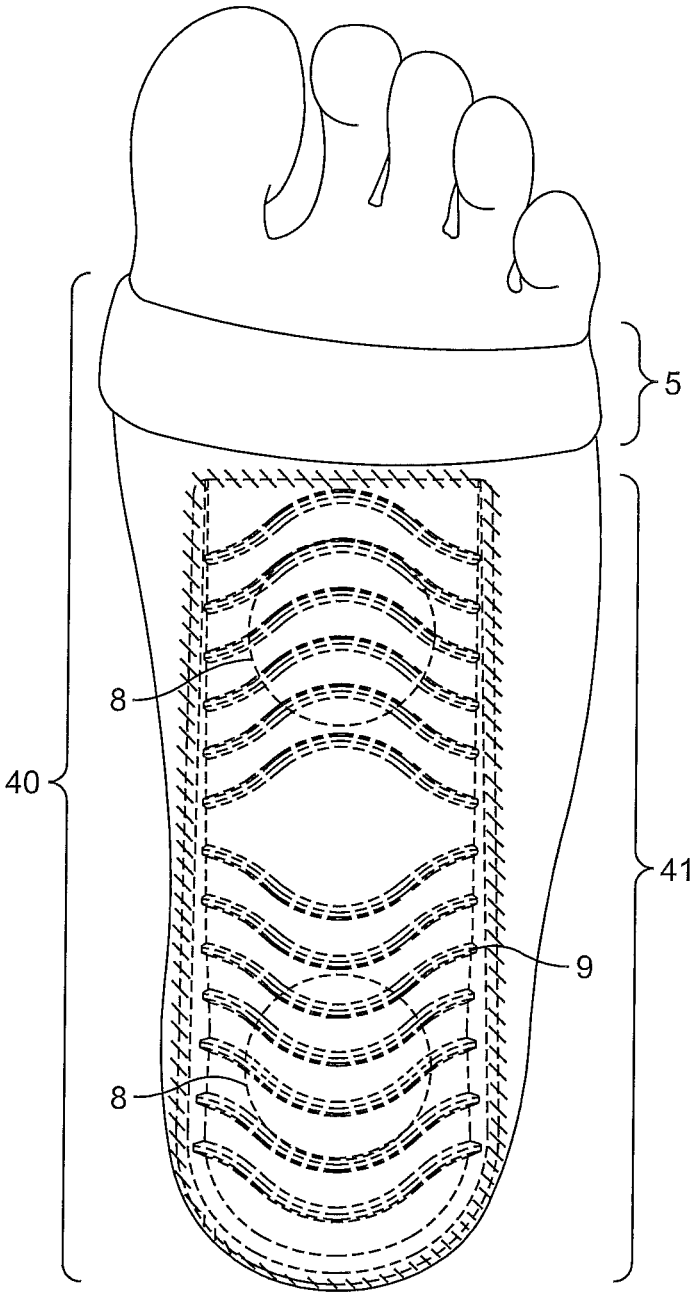
FIG. 12 is a bottom view of the FIG. 11 three-quarter foot sock embodiment.

FIGS. 11-12 show another embodiment of the sock: three-quarter foot sock 40. In this particular example, three-quarter foot sock 40 includes an open toe 24 and partial open forefoot for enhanced tactility, particularly during athletic activity. As indicated in FIG. 11, three-quarter foot sock 40 includes a three-quarter foot shock absorbing assembly 42 within a three-quarter foot cavity assembly running from about the heel to about the forefoot. The cavity may be defined by an inner wall and an outer wall. The three-quarter foot shock absorbing assembly 42 may include three-quarter foot shock absorbing material 41. The three-quarter shock absorbing material 41 may include slip-avoidance grooves 9.

Three-quarter foot sock 40 further includes ankle cuff 4 on its distal end that is adapted to prevent slippage of the sock from the human foot. Ankle cuff 4 may include a fastener to further secure three-quarter foot sock 40 to a human foot, particularly during athletic activity. Similarly, three-quarter foot sock 40 includes three-quarter foot cuff 25 on its proximate end that is adapted to prevent slippage from a user's mid-foot. The three-quarter foot cuff 25 may also include a fastener to further secure three-quarter foot sock 40 to a user's forefoot, particularly during athletic activity.

Optionally, three-quarter foot sock 40 may include a wicking layer that is secured above the inner wall to additionally draw moisture from the human foot toward outer layers.

FIG. 12 shows one example of the three-quarter foot sock 40, wherein stitching 7 secures three-quarter foot shock absorbing material 41 to three-quarter foot sock 40. Further, a stick pad 8 may be secured to three-quarter foot shock absorbing assembly 42 to assist in securing three-quarter foot shock absorbing material 41 to its respective cavity, particularly against its inner walls.

Figure 13:
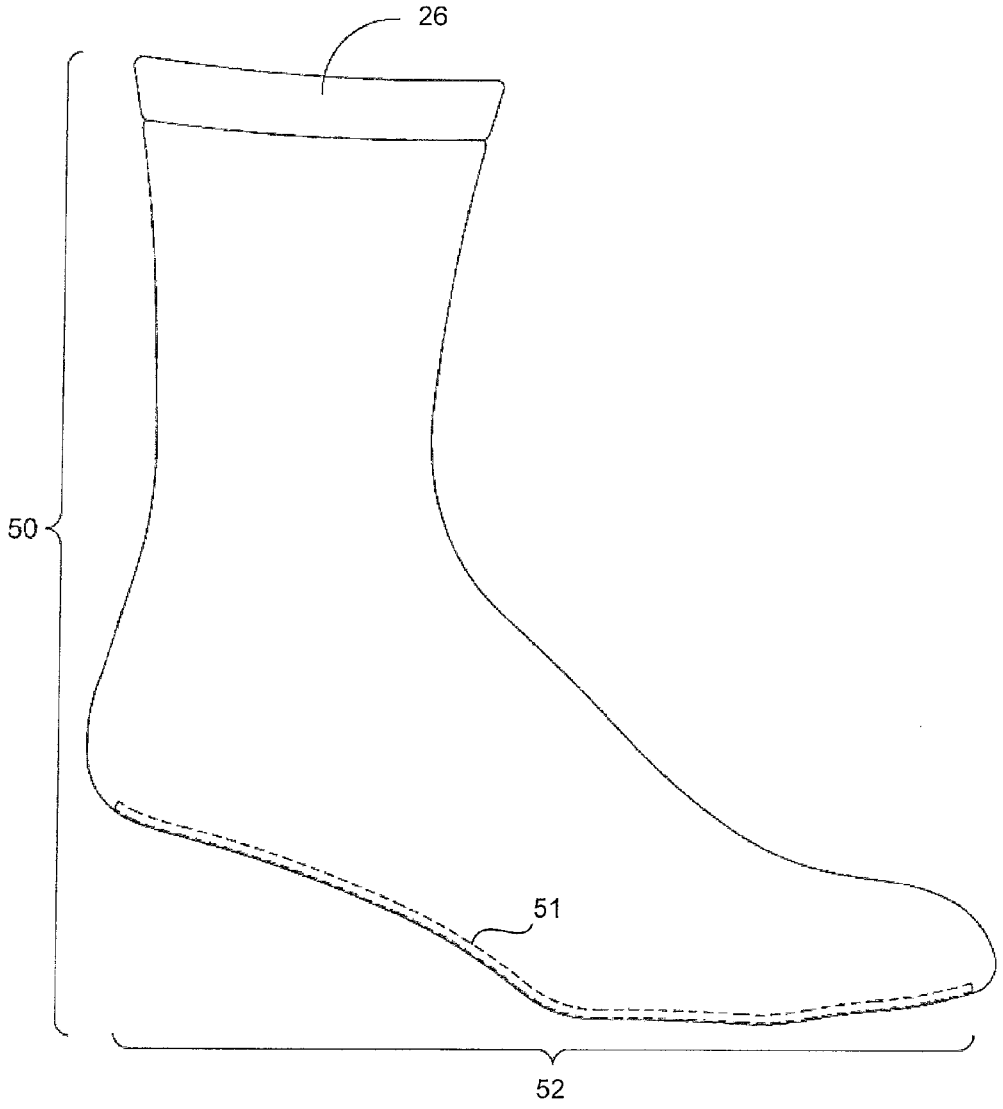
FIG. 13 is a side view of a calf sock embodiment with elongated upper ankle/calf portion.
Figure 14:
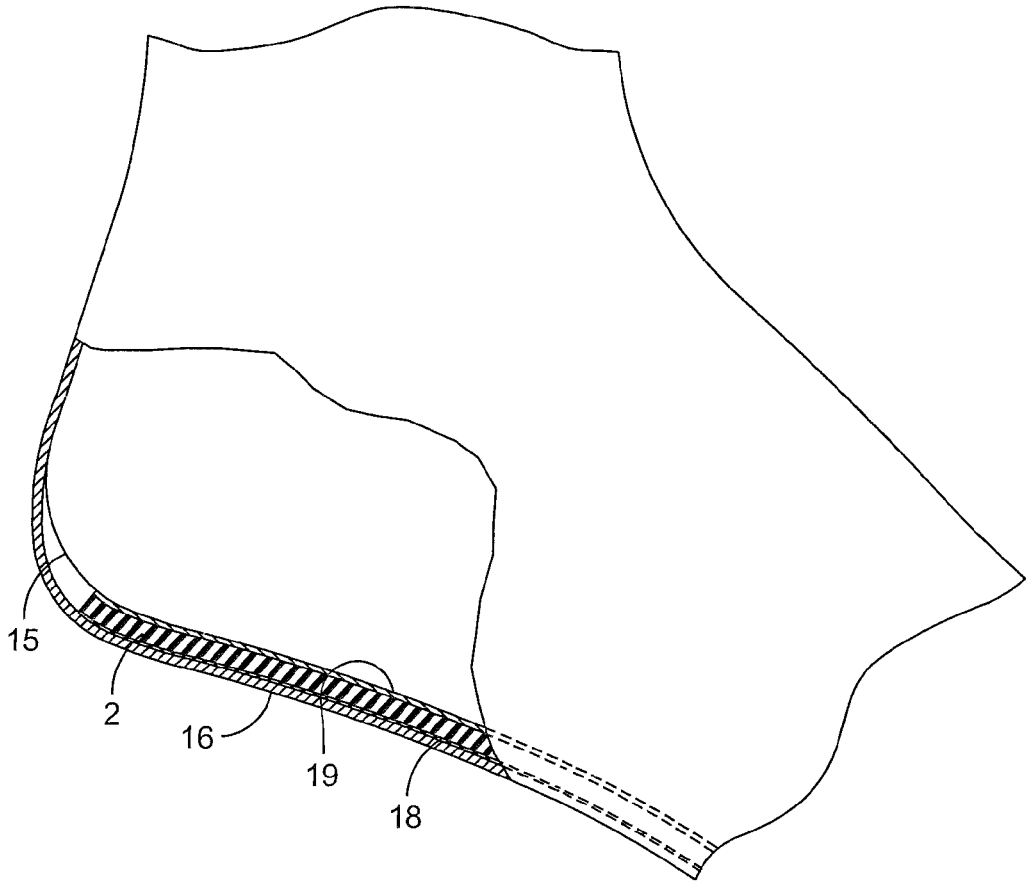
FIG. 14 is a cross-section of the calf sock embodiment of FIG. 13 showing layers, including a wicking layer.

FIGS. 13-17 show a further embodiment of the sock: calf sock 50. As shown in FIG. 13, calf sock 50 encloses the forefoot, toes and at least a portion of the user's calf. As indicated in FIG. 13, calf sock 50 may include full foot shock absorbing assembly 52 within a full foot cavity assembly. The cavity may be defined by an inner wall 15 and an outer wall 6, as shown in FIG. 14. The full foot shock absorbing assembly 52 may include full foot sock shock absorbing material 51. The full foot sock shock absorbing material 51 may include slip-avoidance grooves 9.

Calf sock 50 may further include calf cuff 26 on its distal end that is adapted to prevent slippage of the sock from the human foot, and from wear's calf in particular. Calf cuff 26 may include a fastener to further secure calf sock 50 to a human foot, particularly during athletic activity.

Figure 15:
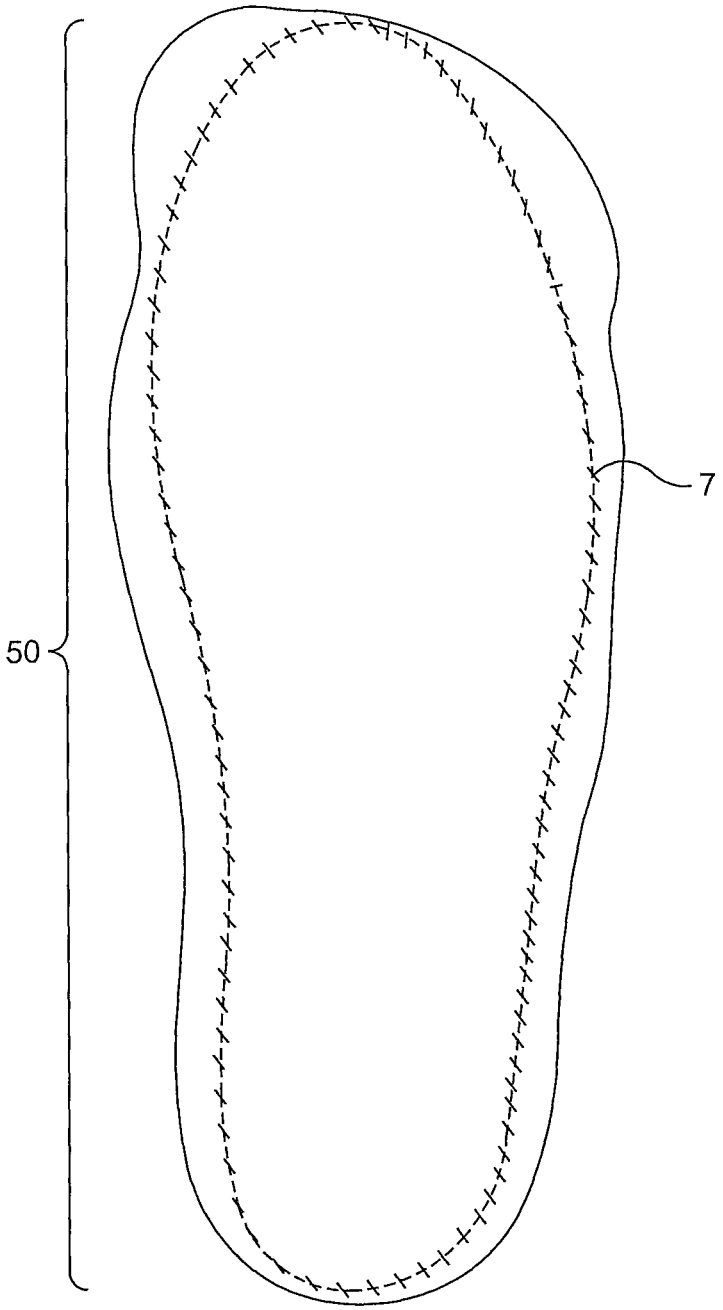
FIG. 15 is a bottom view of the calf sock embodiment of FIG. 13 showing stitching and shock absorbing material within the sock.
Figure 16:
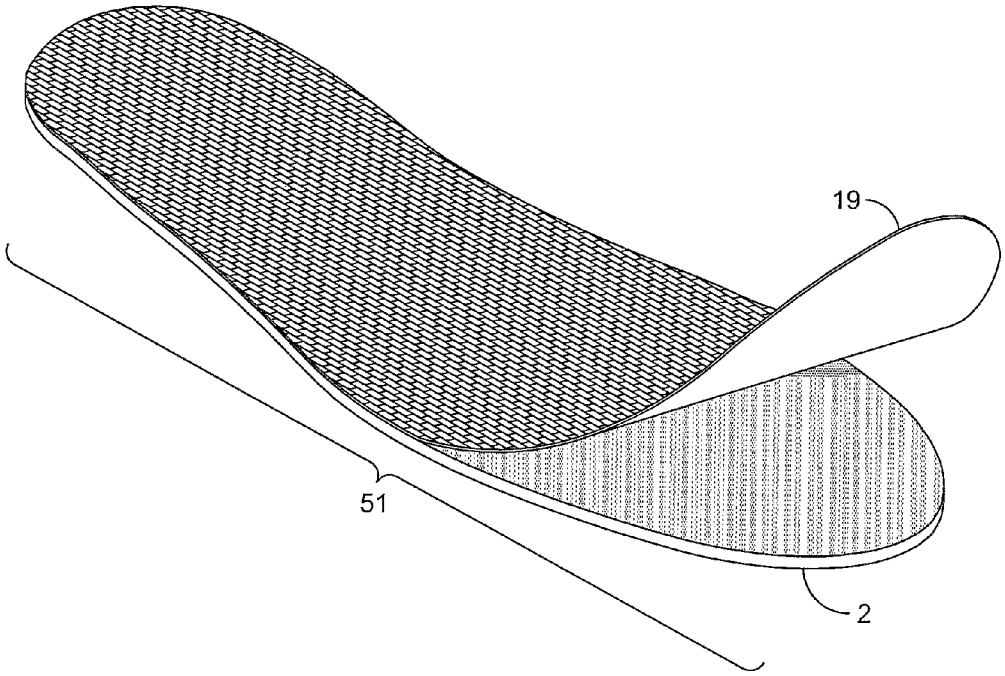
FIG. 16 is a perspective view of the full foot sock shock absorbing material with wicking portion separated from shock absorbing portion of the calf sock embodiment of FIG. 13.

FIG. 15 shows one example of the calf sock 50, wherein stitching 7 secures full foot sock shock absorbing material 51 within full foot shock absorbing assembly 52. Further, as introduced in FIG. 16, calf sock 50 may include a wicking material layer 19 that is substantially the size of the wear's foot and/or an adhesive layer 18. Alternatively an adhesive layer can be used, or a combination of adhesive, such as glue, and stitching. FIG. 16 also shows the full foot shock absorbing assembly 52 with wicking portion 19 separated from shock absorbing material 51.

Figure 17:
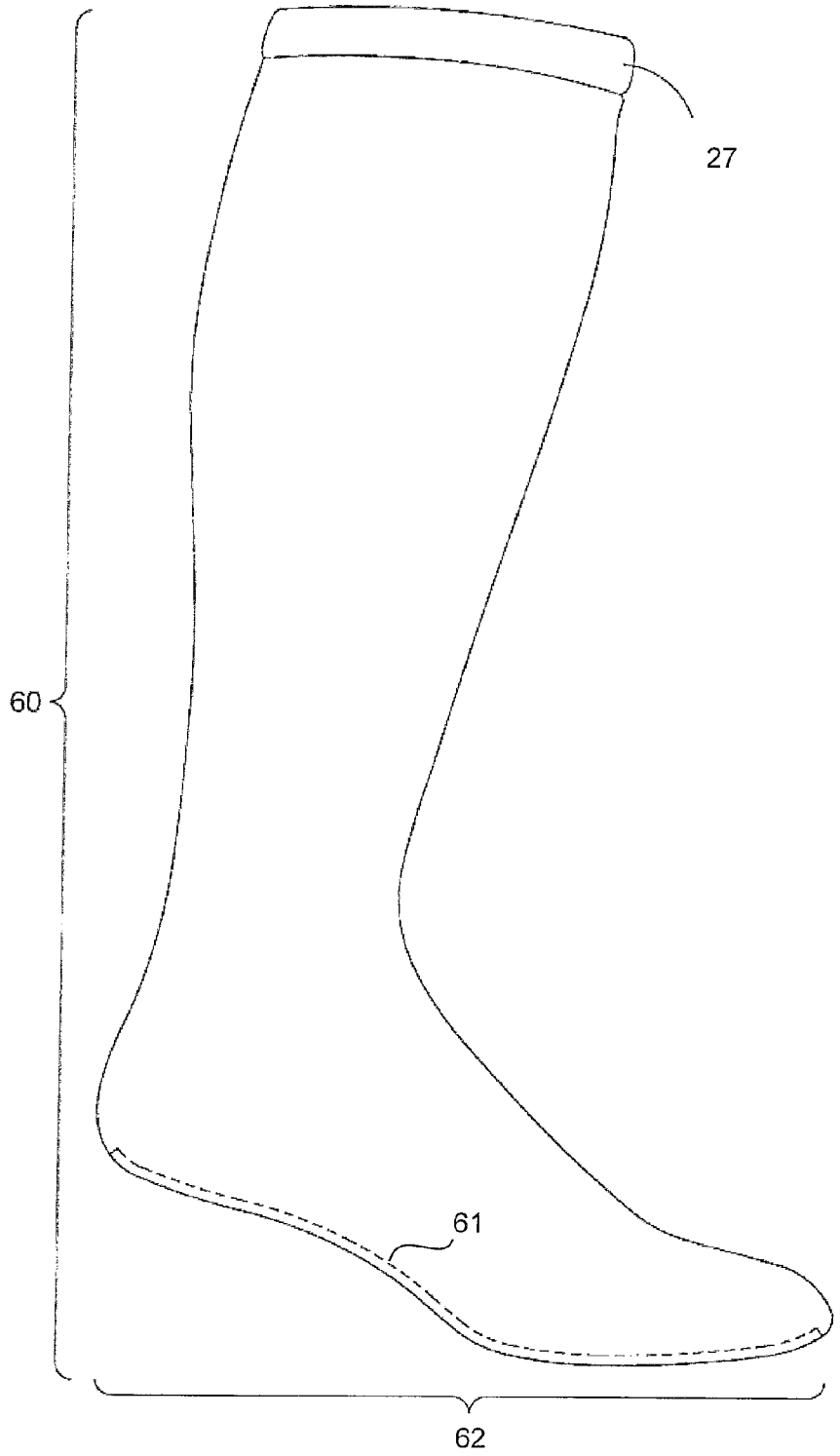
FIG. 17 is a side view of an elongated legging sock embodiment with elongated upper ankle/calf portion.

FIG. 17 illustrates a further embodiment of the sock: a legging sock 60. In this particular example, legging sock 60 encloses the forefoot, toes and at least a portion of the user's leg approaching a knee. Legging sock 60 includes full foot shock absorbing assembly 62 within a full foot cavity assembly. The cavity may be defined by an inner wall and an outer wall, as described above. The full foot shock absorbing assembly 62 may include full foot sock shock absorbing material 61. As previously described, the full foot sock shock absorbing material 61 may include slip-avoidance grooves. Although shown in the context of the full foot embodiments, the various sock layers, including shock absorbing material, wicking material layers, inner and outer walls, cuffs, stitching and adhesive layer can be usefully employed in the legging sock 60 embodiments.

In other embodiments, the disclosure includes a sock retrofit kit. In this embodiment, the kit may comprise a shock absorbing material, e.g. any of the shock absorbing materials previously shown or described. Further, the kit may include a plurality of cuffs, e.g. any of the cuffs shown or described. Most typically, each shock absorbing material may replace a worn-out, or the like, shock absorbing material, for example within an existing cavity assembly, e.g. any of the cavity assemblies previously shown or described.

In yet another embodiment of the disclosure, a method for absorbing foot-strike shock includes donning a foot-strike absorbing sock, e.g. any of the socks previously shown or described, and compressing the sock. In particular embodiments, the method includes donning the sock during athletic activities, for instance gymnastics, running, hockey, skating, or the like, or in other circumstances where foot strike shock is apparent or rehabilitation is advantageous.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A shock-absorbing athletic sock having a shape configured to generally conform to a shape of a human foot, said sock comprising:

(a) a cavity assembly having an inner wall comprising of about fifty-one percent nylon, about forty-seven percent cotton, and about two percent spandex and an outer wall comprising of about fifty-one percent nylon, about forty-seven percent cotton, and about two percent spandex stitched together with an elastic stitching, and a wicking layer comprising microfiber and polyester, said cavity assembly comprising a heel portion and a mid-foot portion, said mid-foot portion aligned with said heel portion;

(b) a shock absorbing assembly having a rear portion and a front portion, wherein said rear portion of said shock absorbing assembly has a visco-elastic polymeric gel having a plurality of grooves extending between opposing sides of said heel portion and having a rear thickness portion tapering toward a lesser front thickness within said cavity assembly and secured by stitching to a bottom portion of said inner wall, said rear thickness portion of said visco-elastic polymeric gel configured to flow under a point contact and configured to distort under a non-point contact, said shock absorbing assembly having a plurality of grooves; and (c) a first cuff and a second cuff, said first cuff positioned at an ankle portion of said sock configured to prevent slippage of said sock from said human foot, said second cuff positioned at a front end of said sock configured to prevent slippage of said sock from a mid-foot of the human.

2. The shock-absorbing athletic sock according to claim 1, wherein the wicking layer is part of a slip-avoidance system.

3. The shock-absorbing athletic sock according to claim 2, wherein said slip-avoidance system includes a stick pad.

4. The shock-absorbing athletic sock according to claim 1, wherein said sock is adapted to be donned without a shoe.

5. A shock-absorbing athletic sock having a shape configured to generally conform to a shape of a human foot, said sock comprising:

(a) a heel portion having a width;

(b) a mid-foot portion, said mid-foot portion aligned to said heel portion;

(c) a shock absorbing assembly including (i) a cavity assembly having an inner wall consisting essentially of about fifty-one percent nylon, about forty-seven percent cotton, and about two percent spandex and an outer wall consisting essentially of about fifty-one percent nylon, about forty-seven percent cotton, and about two percent spandex stitched together with elastic stitching and (ii) a visco-elastic polymeric gel material secured by stitching to a bottom portion of said inner wall and having a plurality of grooves extending across said width of said heel portion, said visco-elastic polymeric gel material having a thickness tapering toward a front portion of said shock absorbing assembly and configured to collapse and configured to flow under a compressive point pressure and configured to rebound when said compressive point pressure is removed; and (d) a slip-avoidance system comprising a wicking layer.

* * * * *